United States Patent [19]

Torsch

[11] 4,070,640

[45] Jan. 24, 1978

[54] HIGH RESOLUTION TORODIDAL DEFLECTION YOKE

[75] Inventor: Charles E. Torsch, Geneva, N.Y.

[73] Assignee: GTE Sylvania Incorporated, Stamford, Conn.

[21] Appl. No.: 785,651

[22] Filed: Apr. 7, 1977

[51] Int. Cl.[2] ..... H01F 7/00

[52] U.S. Cl. ..... 335/213; 335/210

[58] Field of Search ..... 335/210, 212

[56] References Cited

U.S. PATENT DOCUMENTS

| | | | |
|---|---|---|---|
| 3,757,262 | 9/1973 | Over et al. | 335/213 |
| 3,801,941 | 4/1974 | Phillips | 335/213 |
| 3,996,542 | 12/1976 | Barkow | 335/213 |

*Primary Examiner*—George Harris

*Attorney, Agent, or Firm*—Norman J. O'Malley; Thomas H. Buffton; Robert T. Orner

[57] ABSTRACT

A deflection yoke for a cathode ray tube includes a core of magnetic material having front and back end portions, a front crown having a substantially flat outer surface normal to the core member axis and a slotted outer circumferential surface, a back crown member having a slotted surface normal to the core member axis, and a plurality of wire turns toroidally wrapped about the core and front and back crown members with the front crown member having a single layer of wire turns and the back crown member having a first layer at wire turns extending radially and added layers of wire turns extending non-radially to the front crown member. A process for fabricating a deflection yoke includes selecting and affixing crowns to a core member and wrapping wire turns thereon to include a single front layer and multiple back layers.

10 Claims, 4 Drawing Figures

HIGH RESOLUTION TORODIDAL DEFLECTION YOKE

BACKGROUND OF THE INVENTION

This invention relates to deflection yokes for cathode ray tubes and more particularly to a high resolution toroidal-wound deflection yoke having front and back crown members affixed to a core member.

Precision and repeatability of wire placement are reasons frequently expressed for the utilization of toroid-wound deflection yokes for cathode ray tubes. Moreover, such precision and repeatability of wire placement is due to numerous features including the employment of front and back crown members affixed to the front and back ends of a core member of magnetic material. Such crown members usually include slots which permit accurate positional location of the wire turns whereupon uniformity of deflection yokes can be repeatedly achieved.

Although deflection yokes utilizing slotted front and back crown members for determining wire turn placement have been and still are extensively employed, it has been found that there are conditions wherein presently known and available structures are inadequate. For example, presently available front crown members include a plurality of wire receiving slots in a plane parallel to and forward of the front end portion of a core member. Unfortunately, such wire-receiving slots include separating ridges which limit the wire-receiving capabilities and inhibit an intimate relationship of the forward crown member and a cathode ray tube envelope. Thus, it is difficult to provide additional wire turns to enhance the capabilities of the deflection yoke without encountering other difficulties.

Specifically, it has been determined that a deflection yoke with an increased ratio of inductance to resistance would have numerous advantages including an increased efficiency capability. Moreover, it would be highly desirable to achieve this increased ratio of inductance to resistance and efficiency without an undesired increase in spacing between the deflection yoke and a cathode ray tube.

One known method for increasing the inductance to resistance ratio of a deflection yoke is to include additional wire turns about the core member. While such a technique provides the desired increased inductance to resistance ratio, it has been found that the number of added turns has been limited because of the space required to provide slots on the front and back crown members. In other words, the slots are formed by ridges therebetween and the thinness of such ridges is obviously limited by the ability of the ridges to withstand deformity. Moreover, the ridges occupy space which, in turn, reduces the number of wire turns which may be utilized or employed.

Another known attempt at increasing the inductance to resistance ratio included the addition of wire turns by stacking or depositing more than one turn in each slot of the front and back crown members. Although such structures do have advantages, it has been found that stacking of wire turns at the front crown member also deleteriously affects the space relationship of the deflection yoke and picture tube and particularly so at the front end of the deflection yoke. Moreover, the ridges employed to separate the wire turns must necessarily extend further forward than previous structures in order to provide a receptacle for the multiple wire turns per slot which further limits both the snugness of fit between the deflection yoke and the cathode ray tube and undesirably necessitates a reduction in the length of the core member which may be employed.

OBJECTS AND SUMMARY OF THE INVENTION

An object of the present invention is to provide an improved deflection yoke for a cathode ray tube. Another object of the invention is to improve the inductance to resistance ratio of a toroid-wound deflection yoke suitable for use with a cathode ray tube. Still another object of the invention is to provide a deflection yoke having added wire turns and retaining the capability of effecting a snug fit with a cooperating cathode ray tube. A further object of the invention is to provide a deflection yoke having a front end to back end wire receiving slot ratio of at least 3:1 with the front end having a single layer of wire turns. A still further object of the invention is to provide an improved method for fabricating deflection yokes having the above-mentioned capabilities.

These and other objects, advantages and capabilities are achieved in one aspect of the invention by a deflection yoke having a core member of magnetic material with front and back end portions, a front crown member affixed to and having a flat surface parallel to the front end portion and a plurality of slots on an outer circumferential surface of the crown member, a back crown member affixed to and having a plurality of slots on the surface parallel to the back end portion of the core member, and a plurality of wire turns toroidally wrapped about the core and front and back crown members with the slots of the front crown member positionally locating the wire members substantially immediately adjacent one another on the flat surface of the front crown member. Also, the deflection yoke is fabricated by a process which includes selecting a core member, selecting and affixing front and back crown members to the core member, wrapping a first layer of wire turns extending radially between the crown members, and wrapping added layers of wire turns on the back crown member and extending non-radially to a single layer at the front crown member.

PREFERRED EMBODIMENT OF THE INVENTION

For a better understanding of the present invention, together with other and further objects, advantages and capabilities thereof, reference is made to the following disclosure and appended claims in conjunction with the accompanying drawings.

Figure 1:
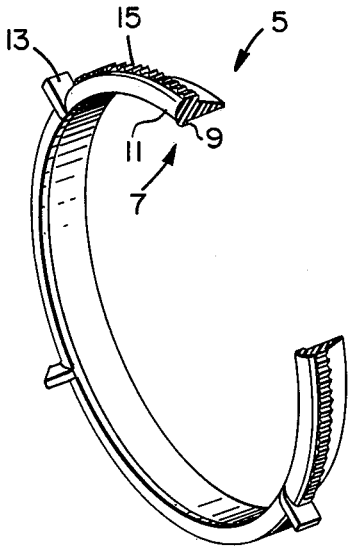
FIG. 1 is a plan view of a front crown member formed in accordance with the invention.

Referring to the drawings, FIG. 1 illustrates a front crown member 5 suitable for use with a core member of magnetic material. The front crown member 5 is substantially circular-shaped and includes a lip portion 7 having a substantially flat inner surface 9 and a substantially flat outer surface 11. The flat inner surface 9 is formed for attachment to the front end portion of a core member and the flat outer surface 11 is formed to support a layer of wire turns as will be further explained hereinafter.

The front crown member 5 also includes a plurality of outwardly extending ear members 13 which are formed to provide a means for supporting the deflection yoke during a wire wrapping portion of the fabrication process and as a means for attaching plastic housing members, if so desired. More importantly, the front crown member 5 includes a plurality of wire-receiving slots 15 disposed on the outer circumferential surface but not extending onto the flat outer surface 11. The significance of the slots 15 on the outer circumferential surface but not on the flat surface 11 will be explained hereinafter.

Figure 2:
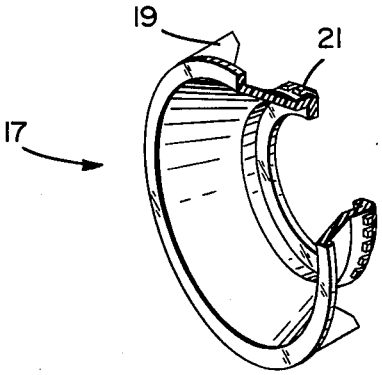
FIG. 2 is a plan view of a back crown member suitable for use with the front crown member of FIG. 1.

FIG. 2 illustrates a back crown member 17 which is formed for attachment to the back end portion of a core member of magnetic material. The back crown member 17 also includes a plurality of ear members 19, substantially similar to the ear members 13 of the front crown member 5, which are formed to provide a support means during a wire wrapping process, attachment of a plastic housing, and assistance in alignment of the front and back crown members 5 and 17 respectively. The back crown member 17 also includes a plurality of wire-receiving slots 21 which are preferably disposed in a plane normal to the longitudinal axis of a core member but may extend onto the outer or inner circumferential surface.

Figure 3:
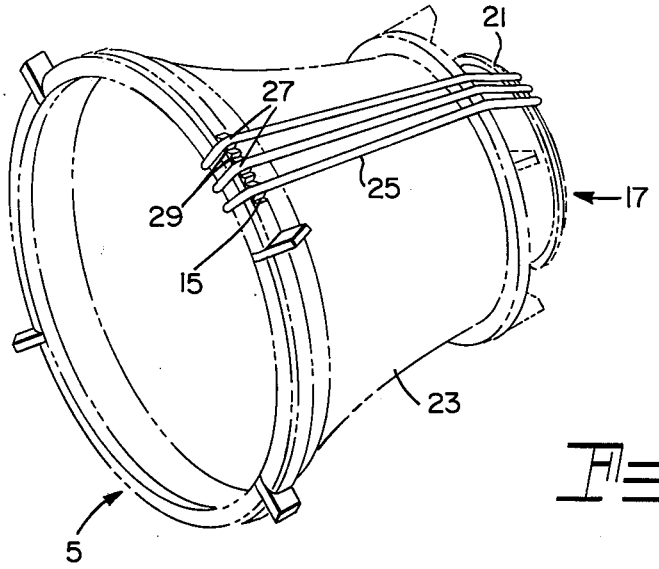
FIG. 3 is a perspective view of a deflection yoke in accordance with the invention and illustrating a first layer wire turns wrapped thereon.

As to the deflection yoke, FIG. 3 illustrates a partially completed embodiment of the invention in that only a single layer of wire turns is illustrated. Herein, the front crown member 5 is affixed to a substantially circular-shaped front end portion of a frustro-conical shaped core member 23 of magnetic material. A back crown member 17 is affixed to a substantially circular-shaped back end portion of the core member 23. A plurality of wire turns 25 are toroidally wrapped about the front and back crown members 5 and 17 and the core member 23.

As to fabrication of the deflection yoke, a frustro-conical shaped core member 23 of magnetic material of a form suitable to telescope over the neck portion of a cathode ray tube is selected. The core member 23 has substantially circular-shaped front and back end portions and the front and back crown members 5 and 17 are affixed to the front and back end portions of the core member 23.

Preferably, the front crown member 5 has at least three times as many wire-receiving slots 15 as the back crown member 17. As can be seen in FIG. 3, the first layer of wire turns includes a wire turn 25 in each one of the wire-receiving slots 21 of the back crown member 17. Also, each pair of wire turns in the wire-receiving slots 21 of the back crown member 17 extend radially to a first pair of wire receiving slots 27 of the front crown member 5 separated by a second pair of wire-receiving slots 29. In other words, a wire turn 25 extends radially from a first wire slot 21 of the back crown member 17 to a first wire-receiving slot 15 of the front crown member 5. A second or following wire turn 25 in an adjacent slot 21 of the back crown member 17 extends radially to a fourth wire-receiving slot 21 of the front crown member 5. Thus, all of the wire turns in a first layer at the back crown member 17 are disposed in a first layer at the front crown member 5.

Figure 4:
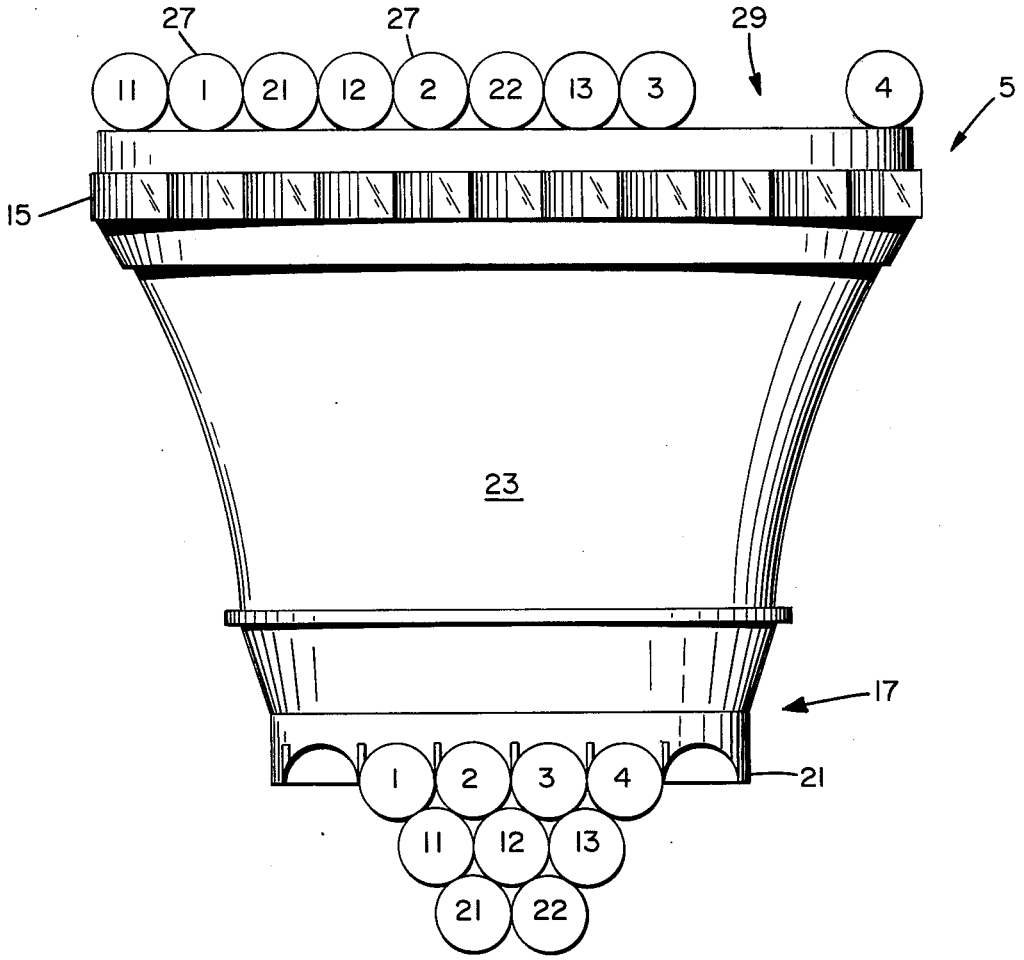
FIG. 4 is a diagrammatic illustration of a deflection yoke of the invention having radial and non-radial wire turns thereon.

Thereafter, wire turns 25 are added by "stacking" or providing added layers of wire turns at the back crown member 17 which extend in a non-radial manner to a single layer at the front crown member 5. As can be more readily seen in the diagrammatic illustration of FIG. 4, a first layer of wire turns on the back crown member 17, represented as 1-2-3-4, are disposed within the slots 21 and extend radially to a first pair of slots 27 separated by a second pair of slots 29 at the front crown member.

Added turns, represented by wires 11-12-13 and 21-22, are "stacked" in multiple layers at the back crown member 17. As can be seen, the multiple layers are supported by the first or previous layers of wire turns and therefore not restricted to positional location by the slots 21. Also, the wire turns of the added layers of turns are directed to the second pair of slots 29 intermediate the first pair of slots 27 receiving the first layer of wire turns. Thus, the added layers of wire turns at the back crown member 7 are directed non-radially to a single layer of wire turns at the front crown member 5.

To briefly review the fabrication of the deflection yoke, a core member of magnetic material is selected, a front crown member having a flat surface parallel to the front end and a plurality of slots on the outer circumferential surface and a back crown member having a plurality of slots on a surface parallel to the back end of the core member are selected and affixed to the front and back end portions of the core member, a first layer of wire turns is disposed in adjacent slots of the back crown member and directed radially to a first pair of slots separated by a second pair of slots at the front crown member, and added layers of wire turns are "stacked" upon and supported by the first layer of wire turns at the back crown member and directed non-radially to the second pair of slots intermediate the first pair of slots forming a single layer of wire turns at the front crown member.

It is to be noted that the utilization of wire receiving slots 15 on the circumferential surface rather than on the flat surface 11 of the front crown member 5 permits the wire turns to be placed substantially immediately adjacent one another in a single layer on the flat surface 11. Thus, the single layer of wire turns at the front crown member 5 permits a snugness of fit between the deflection yoke and a cathode ray tube (not shown) which is unattainable when multiple layers of wire turns are employed or when the wire-receiving slots are on the forward portion of the front crown member 5.

Further, it has been found that the utilization of multi-layered turns on the back crown member 17 does not impede any tilting or movement of the deflection yoke necessary to achieve a desired alignment. However, the added turns provided by the multiple layers at the back crown member 17 and a single layer at the front crown member 5 do provide a most desirable and beneficial increase in the inductance to resistance ratio of the deflection yoke.

Thus, there has been provided a unique toroid-wound deflection yoke having an improved inductance to resistance ratio due to an increased member of wire turns. Moreover, the provision of a front crown member with a substantially flat forward surface whereon the wire turns are supported and whereon the wire turns are in a single layer without need for wire-receiving slots permits utilization of a relatively long core member and a snug fit between the deflection yoke and a cathode ray tube. Thus, efficiency of the system is enhanced and drive power requirements are reduced.

While there has been shown and described what is at present considered the preferred embodiments of the invention, it will be obvious to those skilled in the art that various changes and modifications may be made therein without departing from the scope of the invention as defined by the appended claims.

What is claimed is:

1. A deflection yoke for a cathode ray tube comprising:

a core member of magnetic material having a front end, a back end and a longitudinal axis;

a front crown member affixed to said front end of said core member and having a substantially flat surface normal to said longitudinal axis and parallel to said front end of said core member and an outer circumferential surface substantially parallel to said longitudinal axis and having a plurality of slots therein;

a back crown member affixed to said back end of said core member and having a plurality of slots on at least the surface normal to said longitudinal axis, said back crown member and said front crown member having a slot ratio of about 1:3; and a plurality of wire turns toroidally wrapped about said core and first and second crown members, said wire turns being positionally located to provide a single layer of wire turns at said front end of said core member with not more than one wire turn in a slot of said front crown member and a plurality of layers of wire turns at said back crown member with said slots of said back crown member each supporting a first layer wire turn and adjacent wire turns supporting layers other than the first layer or wire turns.

2. The deflection yoke of claim 1 wherein said slots of said front crown member and back crown member are of a ratio of about 3:1.

3. The deflection yoke of claim 1 wherein a first layer of wire turns disposed in adjacent slots of said back crown member extend radially to a first pair of slots separated by a second pair of slots of said front crown member and wire turns of additional layers of turns of said back crown member extend non-radially to said second pair of slots separating said first pair of slots containing said wire turns of said first layer of wire turns.

4. A deflection yoke for a cathode ray tube comprising:

a frustro-conical shaped core member of magnetic material having a longitudinal axis and substantially circular front and back end portions, said core member being formed to telescope over the neck portion of a cathode ray tube;

a substantially circular-shaped back crown member affixed to said substantially circular-shaped back end portion of said core member and having a plurality of wire-receiving slots on a surface substantially parallel to said back end portion of said core member;

a substantially circular-shaped front crown member affixed to said substantially circular-shaped front end portion of said core member and having a substantially flat surface parallel to said front end portion and a plurality of wire receiving slots on an outer circumferential surface thereof; and a plurality of wire turns toroidally wrapped about said core and front and back crown members, said wire turns being positionally located to effect a single layer at said front crown member and multiple layers at said back crown member with a first layer of said multiple layers at said back crown member extending radially of said core member and added layers of said multiple layers of wire turns at said back crown member extending non-radially of said core member, said front and back crown members having slots in a ratio of at least 3:1, and layers of wire turns in a ratio of at least 1:3.

5. The deflection yoke of claim 4 wherein wire turns in adjacent slots of a first layer of wire turns at said back crown member are disposed in a first pair of slots separated by a second pair of slots of said front crown member.

6. The deflection yoke of claim 5 wherein wire turns in layers other than the first layer at said back crown member are disposed in said second pair of slots of said front crown member.

7. A deflection yoke fabricating process comprising the steps of:

selecting a frustro-conical shaped core member of magnetic material having substantially circular front and back end portions and formed to telescope over the neck portion of a cathode ray tube;

selecting and affixing front and back crown members to said front and back end portions of said core member, said front crown member having a substantially flat surface parallel to said front end portion and a plurality of wire-receiving slots on an outer circumferential surface and said back crown member having a plurality of wire receiving slots in a surface parallel to said back end portion, said front crown member having three times the wire-receiving slots of the back crown members;

wrapping a first layer of wire turns in adjacent slots of said back crown members and extending radially to a first pair of slots separated by a second pair of slots on said front crown member; and wrapping added layers of wire turns on said back crown member and non-radially in said second pair of slots on said front crown member to provide a single layer of turns on said front crown member.

8. The process of claim 7 wherein said wrapping added layers of wire turns on said back crown member includes the depositing of said wire turns of said added layers onto adjacent wire turns of previous layers providing support therefore.

9. The process of claim 7 wherein said wrapping added layers of wire turns on said back crown member includes the provision of front to back layers of wire in a ratio of about 1 to 3.

10. The process of claim 7 wherein said selecting and affixing of front and back crown members includes selection of a front crown member and back crown member with a slot ratio of about 3:1 and said wrapping added layers of wire turns includes the provision of front crown to back crown wire layers in a ratio of about 1:3.

* * * * *